US008608168B2

(12) United States Patent
Rowan

(10) Patent No.: US 8,608,168 B2
(45) Date of Patent: Dec. 17, 2013

(54) STORAGE STRUCTURE USED AS A TARGET AND A BOUNCE BACK FOR PROJECTILES

(76) Inventor: Marian Rowan, Houston, TX (US)

( * ) Notice: Subject to any disclaimer, the term of this patent is extended or adjusted under 35 U.S.C. 154(b) by 364 days.

(21) Appl. No.: 12/859,211

(22) Filed: Aug. 18, 2010

(65) Prior Publication Data

US 2011/0042246 A1 Feb. 24, 2011

Related U.S. Application Data

(60) Provisional application No. 61/274,590, filed on Aug. 19, 2009.

(51) Int. Cl.
*F41J 5/00* (2006.01)
*B65D 85/20* (2006.01)

(52) U.S. Cl.
USPC ..... 273/378; 206/315.1; 273/127 R; 473/476

(58) Field of Classification Search
USPC ..... 273/317, 317.1, 317.4, 331, 333, 348, 273/358, 378, 127 R, 407; 473/476, 479, 473/480; 135/96, 116, 121; 206/315.1
See application file for complete search history.

(56) References Cited

U.S. PATENT DOCUMENTS

| | | | | | |
|---|---|---|---|---|---|
| 1,267,722 | A * | 5/1918 | Walter | 273/378 |
| 4,247,116 | A * | 1/1981 | McQuary | 273/407 |
| 5,449,170 | A * | 9/1995 | Clements | 273/127 B |
| 5,664,784 | A * | 9/1997 | Redlich et al. | 473/476 |
| 5,979,899 | A * | 11/1999 | Wilson | 273/407 |
| 6,641,139 | B2 * | 11/2003 | Lamberti et al. | 273/378 |
| 6,969,068 | B1 * | 11/2005 | Pollon et al. | 473/476 |
| 2007/0013138 | A1 * | 1/2007 | Hinnant | 273/407 |

* cited by examiner

*Primary Examiner* — Luan K Bui

(57) ABSTRACT

A storage structure can be used as a target and bounce back for projectiles. The storage structure can include a fixed slightly angled wall (relative to the ground) or may include an adjustable angled wall. The face of the target may include markers to indicate desired projectile strike locations for one or more sports. These markers may be painted on, supplied as a tarp to place over a surface, or provided as colored building materials. For example, an 8 foot by 24 foot box may be indicated on the face of the target to mimic a soccer net. The storage structure may provide not only a storage facility, but also an invitation for users to play, practice and perfect their coordination, reaction time, and skill at various sports.

3 Claims, 3 Drawing Sheets

STORAGE STRUCTURE USED AS A TARGET AND A BOUNCE BACK FOR PROJECTILES

CROSS-REFERENCE TO RELATED APPLICATIONS

This application claims the benefit of priority to U.S. Provisional patent application No. 61/274,590, filed Aug. 19, 2010, herein incorporated by reference in its entirety.

BACKGROUND OF THE INVENTION

The present invention relates to a storage structure and, more particularly, to a storage structure having a target and a bounce back surface for projectiles.

Typical storage structures are placed out of the way for both aesthetic reasons as well as so not to use valuable play space. Typical playback surfaces structures that are deployed for use and put away after use, usually to save play space as well as to reduce theft and/or vandalism.

As can be seen, there is a need for a storage structure that may include a targeted playback surface.

SUMMARY OF THE INVENTION

In one aspect of the present invention, a storage structure having a target indicated thereupon, comprises at least one target wall having the target indicated thereupon; a top side of the storage structure connected to and supported by the target wall; at least one second wall connected to and supported by the target wall.

These and other features, aspects and advantages of the present invention will become better understood with reference to the following drawings, description and claims.

DETAILED DESCRIPTION OF THE INVENTION

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Various inventive features are described below that can each be used independently of one another or in combination with other features.

Broadly, an embodiment of the present invention provides a storage structure that can be used as a target and bounce back for projectiles. The storage structure can include a fixed slightly angled wall (relative to the ground) or may include an adjustable angled wall. The adjustable wall may be part of a structure or may be used in conjunction with other structures. The face of the target may include markers to indicate desired projectile strike locations for one or more sports. For example, an 8 foot by 24 foot box may be indicated on the face of the target to mimic a soccer net. The storage structure may provide not only a storage facility, but also an invitation for users to play, practice and perfect their coordination, reaction time, and skill at various sports. The storage structure may be as small as a 4 foot by 4 foot structure. Typically, the storage structure may be from about 10 to about 14 feet high and from about 30 to about 40 feet long.

Figure 1:
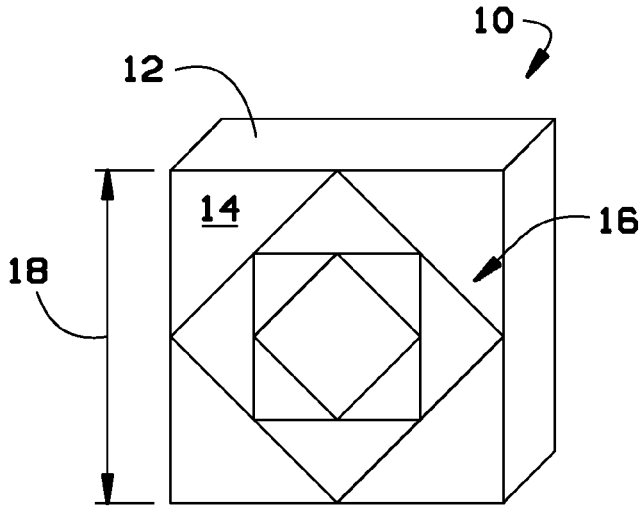
FIG. 1 is a perspective view of a storage structure used as a target and bounce back surface, according to an embodiment of the present invention.

Referring to FIG. 1, a storage structure 10 may be, for example, a rectangular box having a lid 12. The lid 12 may be at least partially removable from the top of the storage structure 10, for example, by a hinge (not shown). A face 14 of the storage structure 10 may include a target 16. The target 16 may be colored and designed to mimic a sport strike location for a projectile, as discussed in greater detail below. Alternatively, the target 16 may be artwork on at least one face 14 of the storage structure 10. For example, in a children's park, the artwork may include animals of different colors that a child may indicate by name and/or color. The target 16 may be painted on the face 14 of the storage structure, indicated by colored building material, or disposed as a colored tarp, as discussed below. The target 16 may be on an exterior face or interior face of the storage structure 10. In the embodiment of FIG. 1, the height 18 of the storage structure 10 may be limited to permit a user to access the inside of the storage structure 10.

Figure 2:
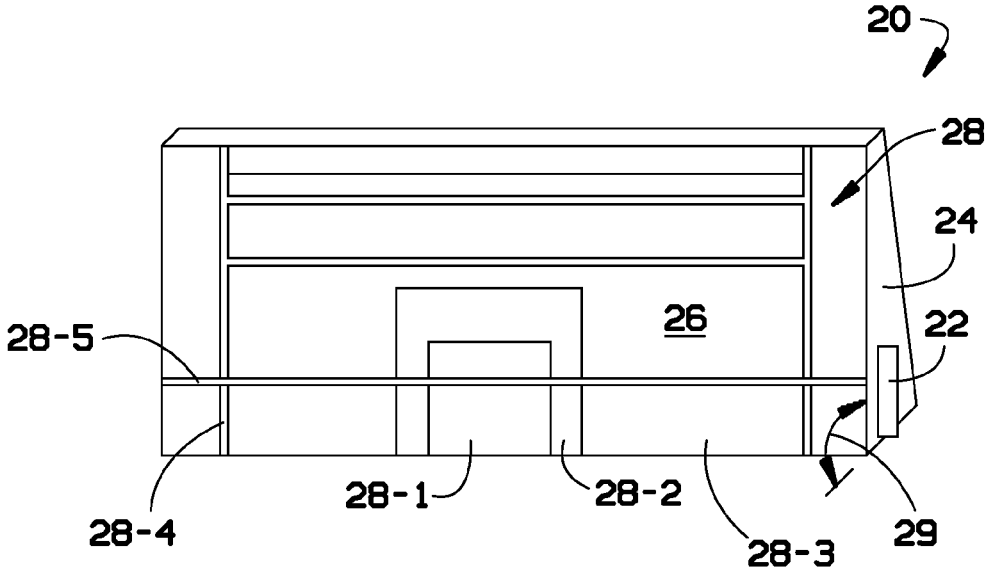
FIG. 2 is a perspective view of another exemplary embodiment of a storage structure used as a target and bounce back surface.

Referring to FIG. 2, a storage structure 20 may include a door 22, typically in a side 24 of the storage structure 20, to access the inside of the storage structure 20. The door 22 may be a typical entry door. Optionally, the door 22 may include an overhead door alone or an overhead door used in conjunction with an entry door. A face 26 of the storage structure 20 may have one or more sport goals 28 indicated thereupon. For example, the face 26 may have a 4 foot by 4 foot hockey goal 28-1, a 6 foot by 6 foot lacrosse goal 28-2, a 8 foot by 24 foot soccer goal 28-3, a 7.5 foot by 30 foot volleyball goal 28-4, a 3 foot by 36 foot tennis goal 28-5, and the like. The face 26 may include only one goal 28 or multiple goals 28 indicated thereupon. The face 26 of the storage structure 20 may be disposed at an angle 29 relative to the ground. The angle 29 may be from about 90 degrees to about 120 degrees, for example, depending on the desired bounce back of projectiles striking the face 26 of the storage structure 20.

Figure 3:
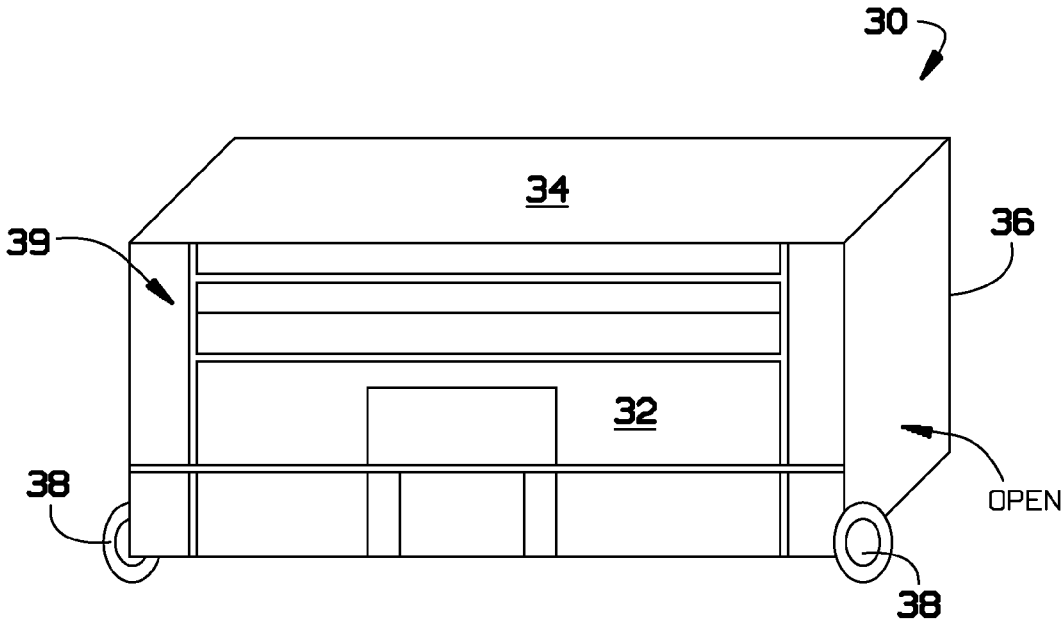
FIG. 3 is a perspective view of a further exemplary embodiment of a storage structure used as a target and bounce back surface.

Referring to FIG. 3, a storage structure 30 may be designed similar to a carport, with a face side 32, a top side 34 and a back side 36. Wheels 38 may be provided on the face side 32 to provide an adjustable angle of the face side 32 relative to the ground. The wheels 38 may have a locking mechanism (not shown), as is known in the art, to prevent undesired movement once a desired adjustable angle is chosen. The wheels 38 may also provide portability to the storage structure 30. Similar to the embodiment of FIG. 2, the storage structure 30 may include a plurality of targets 39 indicated on its face side 32.

Figure 4:
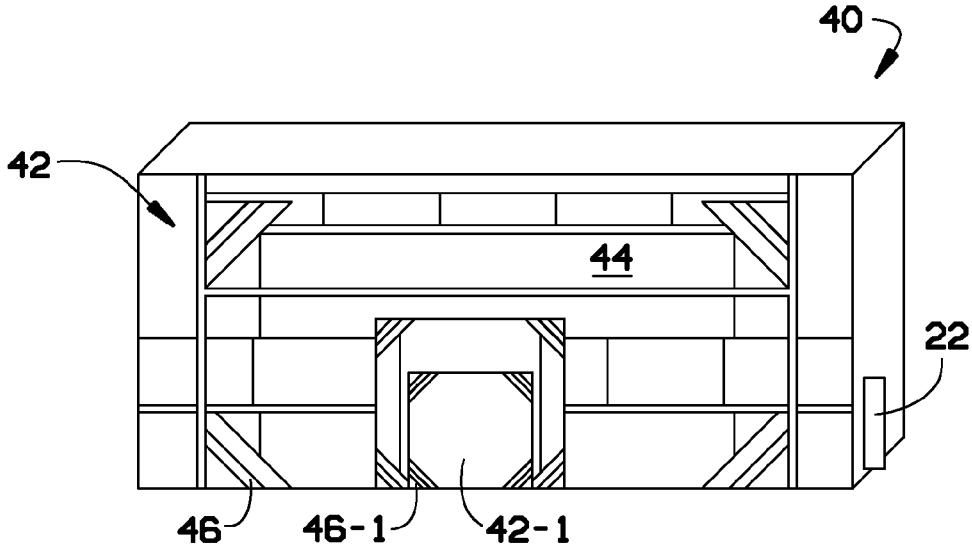
FIG. 4 is a perspective view of yet another exemplary embodiment of a storage structure used as a target and bounce back surface.

Referring to FIG. 4, a storage structure 40 may have a plurality of targets 42 indicated on a face 44 thereof. The targets 42 may include an indication of various "sweet spots" 46. For example, in a hockey goal 42-1, hockey goal sweet spots 46-1 may be located in each corner of the hockey goal

42-1. This may allow a user to aim for various sweet spots 46 depending on the sport being played against the storage structure 40.

Figure 5:
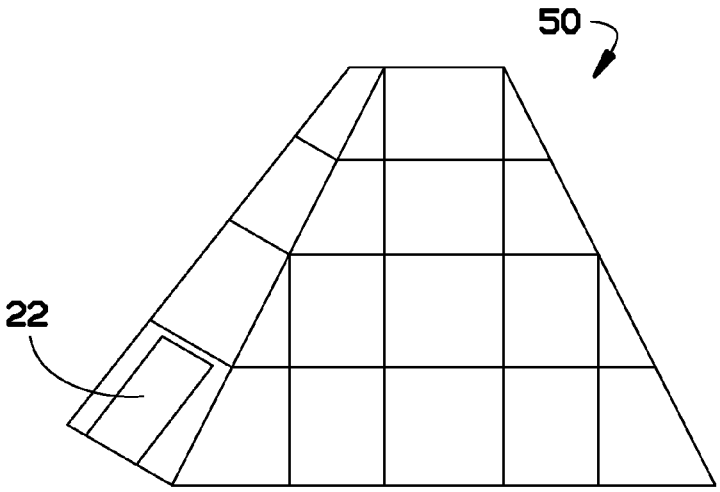
FIG. 5 is a perspective view of yet another exemplary embodiment of a storage structure used as a target and bounce back surface.

Referring to FIG. 5, various shapes may be used for the storage structure. For example, a trapezoidal storage structure 50 may be designed. Other shapes may include, for example, semi-circular, rectangular, square, pyramidal or the like.

Figure 6:
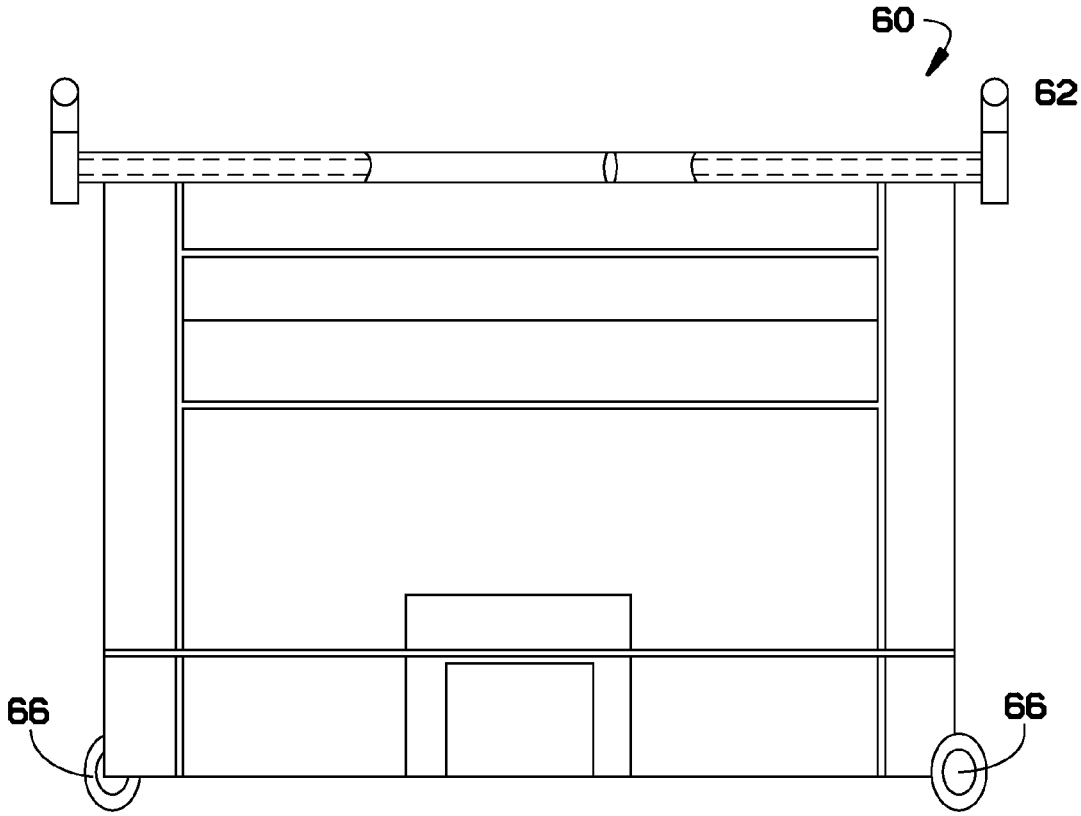
FIG. 6 is a perspective view of yet another exemplary embodiment of a storage structure used as a target and bounce back surface.

Referring to FIG. 6, a portable target 60 may be disposed against a storage structure (not shown). The portable target 60 may be carried by a frame 62 on wheels 64. The frame 62 may attach to the storage structure (or some other solid structure) and the wheels 64 may be used to adjust the angle of a striking face 66 of the portable target 60 relative to the ground. The frame 62 may be adjusted to various sizes, as is known in the art, to accommodate various sized portable targets.

The sport targets described above (for example, targets 42) may be inscribed on a piece of material, such as a tarp (not shown). The tarp may be hung on a building or other flat surface, to provide a bounce back and target for a user to practice one more sports. The sport targets may be indicated on one more sides of a storage building (for example, storage building 40), thereby providing multiple play areas on a single storage building. The face of the storage building may include disks, such as reflective disks, that may change an angle of return of a projectile bounced from the surface, thereby requiring a user to quickly react.

It should be understood, of course, that the foregoing relates to exemplary embodiments of the invention and that modifications may be made without departing from the spirit and scope of the invention as set forth in the following claims.

What is claimed is:

1. A storage structure comprising: a plurality of side walls including at least one target wall having a target indicated thereupon; a top side wall of the storage structure connected to and supported by the plurality of side walls; the plurality of side walls formed an enclosed region inside of the storage structure; a door is formed in one of the plurality of side walls and the door permitting access to the enclosed region; wherein the target wall is removably attached to the storage structure and the target wall is disposed at an angle to the ground that is between 90° and 120°; wherein the target corresponds to one or more sport goals; and wherein the top side wall is a lid removably attached to the plurality of side walls.

2. The storage structure of claim 1, wherein the one or more sport goals include one or more sweet spots for a sport corresponding to the one or more sport goals.

3. The storage structure of claim 1, wherein the target is indicated on the target wall via either painting, using colored building materials or by placing a tarp over the target wall.

* * * * *